US007909217B2

(12) United States Patent
Aguirre et al.

(10) Patent No.: US 7,909,217 B2
(45) Date of Patent: Mar. 22, 2011

(54) VARIABLE OUTWARD CLINCH STAPLER

(75) Inventors: Juan Ignacio Aguirre, East Greenwich, RI (US); Prudencio S. Canlas, Jr., North Kingstown, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 6 days.

(21) Appl. No.: 12/222,484

(22) Filed: Aug. 11, 2008

(65) Prior Publication Data

US 2008/0302848 A1 Dec. 11, 2008

Related U.S. Application Data

(63) Continuation of application No. 10/958,404, filed on Oct. 6, 2004, now Pat. No. 7,422,134.

(51) Int. Cl.
*B27F 7/16* (2006.01)

(52) U.S. Cl. ..... 227/108; 227/82; 227/83; 227/123; 227/88; 227/89; 227/90; 227/61; 227/120; 227/132

(58) Field of Classification Search ..... 227/82–83, 227/123, 108, 88–90, 61, 120, 132
See application file for complete search history.

(56) References Cited

U.S. PATENT DOCUMENTS

| | | | | |
|---|---|---|---|---|
| 2,765,466 | A | 10/1956 | Gaines | |
| 2,959,786 | A | 11/1960 | Peterssen | |
| 3,152,335 | A | 10/1964 | Wandel et al. | |
| 3,182,878 | A | 5/1965 | Abrams | |
| 3,291,357 | A | 12/1966 | Ruskin | |
| 3,417,908 | A | 12/1968 | Treatman | |
| 3,788,187 | A | 1/1974 | Knohl | |
| 3,807,619 | A | 4/1974 | Doyle | |
| 3,822,816 | A | 7/1974 | Doyle | |
| 3,855,688 | A | 12/1974 | Knohl | |
| 3,915,366 | A | 10/1975 | Mitchell | |
| 4,013,206 | A | 3/1977 | Lemos | |
| 4,206,863 | A * | 6/1980 | Savino | 227/83 |
| 4,574,992 | A | 3/1986 | Holman | |
| 4,623,084 | A | 11/1986 | Olesen | |
| 5,664,722 | A * | 9/1997 | Marks | 227/132 |
| 5,967,397 | A | 10/1999 | Fealey | |
| 6,193,126 | B1 | 2/2001 | Lee | |
| 6,772,930 | B2 | 8/2004 | Ayres | |
| 7,422,134 | B2 * | 9/2008 | Aguirre et al. | 227/83 |

* cited by examiner

*Primary Examiner* — Rinaldi I. Rada
*Assistant Examiner* — Michelle Lopez
(74) *Attorney, Agent, or Firm* — Pillsbury Winthrop Shaw Pittman LLP

(57) ABSTRACT

A pneumatically operated stapler that has a single selectively operable adjuster operatively associated with a staple leg diverter. The single selectively operable adjuster is constructed and arranged to be adjusted within a range of leg deflecting positions to affect the lateral movement of the staple leg diverter. The different leg deflective positions effects an amount to which the diverter will deflect the legs of the driven staple during a drive stroke. A single operation of the single selectively operable adjuster both moves the adjuster and retains the adjuster in an adjusted position within the range of leg deflecting positions.

20 Claims, 11 Drawing Sheets

VARIABLE OUTWARD CLINCH STAPLER

CROSS-REFERENCE TO RELATED APPLICATIONS

This application is a continuation of U.S. patent application Ser. No. 10/958,404, filed on Oct. 6, 2004, which issued as U.S. Pat. No. 7,422,134 on Sep. 9, 2008, the entire content of which is incorporated herein by reference.

BACKGROUND OF THE INVENTION

1. Field of the Invention

This application relates to staplers or staple driving devices capable of effecting an outward clinch of the staple within the workpiece as it is driven and more particular to such devices capable of being adjustable to selectively effect any amount of leg deflection within a range of leg deflections and/or to selectively effect no significant deflection or a selective amount of outward leg deflection.

2. Description of Related Art

Staple driving devices of the type herein contemplated are known in the prior art. An essential of all devices of this type, whether adjustable or not, is the provision of a movable staple leg diverting member or anvil which is normally mounted for movement into and out of the drive track. An example of a non-adjustable outward clinching mechanism is disclosed in U.S. Pat. No. 3,807,619, the disclosure of which is hereby incorporated by reference into the present specification. The anvil includes outward clinching surfaces disposed in a position to be engaged by the legs of the staple during the drive stroke of the staple by the staple driving member. The anvil also includes anvil moving surfaces disposed in a position to be engaged by the crown of the staple during the drive stroke of the staple by the staple driving member. The engagement of the anvil moving surfaces functions to move the clinching surfaces of the anvil out of the drive track toward the end of the drive stroke so as to allow the staple crown to pass through the drive track and into the workpiece.

One adjustable stapler of the type herein contemplated which is marketed by the owners of the present application achieves adjustability through a range of outward deflections by moving the anvil through a range in the direction of extent of the drive track. See also, U.S. Pat. No. 4,013,206, the disclosure of which is hereby incorporated into the present specification. In the commercially available device, no significant leg deflection is achieved by locking the anvil out of the drive track by a pair of laterally movable set screws provided solely for that purpose. There exists a need for a stapler of the type described in which adjustability as between no significant leg deflection and an adjustable range of leg deflections is achieved by an adjusting mechanism which is simpler in construction, easier to operate and more economical to manufacture than the adjustment mechanisms provided by the prior art.

SUMMARY OF THE INVENTION

According to an aspect of embodiments of the present invention, there is provided a stapler for driving successive staples into a workpiece, each staple having a crown and legs extending from opposite crown ends. The stapler includes a drive track, a magazine assembly constructed and arranged to supply successive leading staples into the drive track, and a staple driver mounted in the drive track for movement through successive cycles including (1) a drive stroke during which a leading staple in the drive track is moved by the staple driver outwardly of the drive track and into a workpiece, and (2) a return stroke. The stapler also includes a staple leg diverter constructed and arranged for lateral movement out of and into the drive track. The staple diverter deflects the legs of a driven staple during the drive stroke. A single selectively operable adjuster is operatively associated with the staple leg diverter. The single selectively operable adjuster is constructed and arranged to be adjusted within a range of leg deflecting positions to affect the lateral movement of the staple leg diverter. The different leg deflective positions effect an amount to which the diverter will deflect the legs of the driven staple during the drive stroke. A single operation of the single selectively operable adjuster both moves the adjuster and retains the adjuster in an adjusted position within the range of leg deflecting positions.

According to an aspect of embodiments of the present invention, there is provided a method for driving a staple into a workpiece with a stapler, each staple having a crown and legs extending from opposite crown ends. The method includes adjusting a single selectively operable adjuster in a single operation that both adjusts a lateral position of the staple leg diverter relative to a drive track of the stapler and locks the adjuster in place, and driving a staple through the drive track with a driver member. The adjustment of the adjuster determines an amount of outward clinch provided to the staple by the staple leg diverter as the staple exits the drive track.

These and other aspects, features, and advantages of this invention will become apparent from the following detailed description when taken in conjunction with the accompanying drawings, which are part of this disclosure and which illustrate, by way of example, the principles of this invention.

BRIEF DESCRIPTION OF THE DRAWINGS

Features of the invention are shown in the drawings, which form part of this original disclosure, in which.

DETAILED DESCRIPTION OF THE INVENTION

Figure 1:
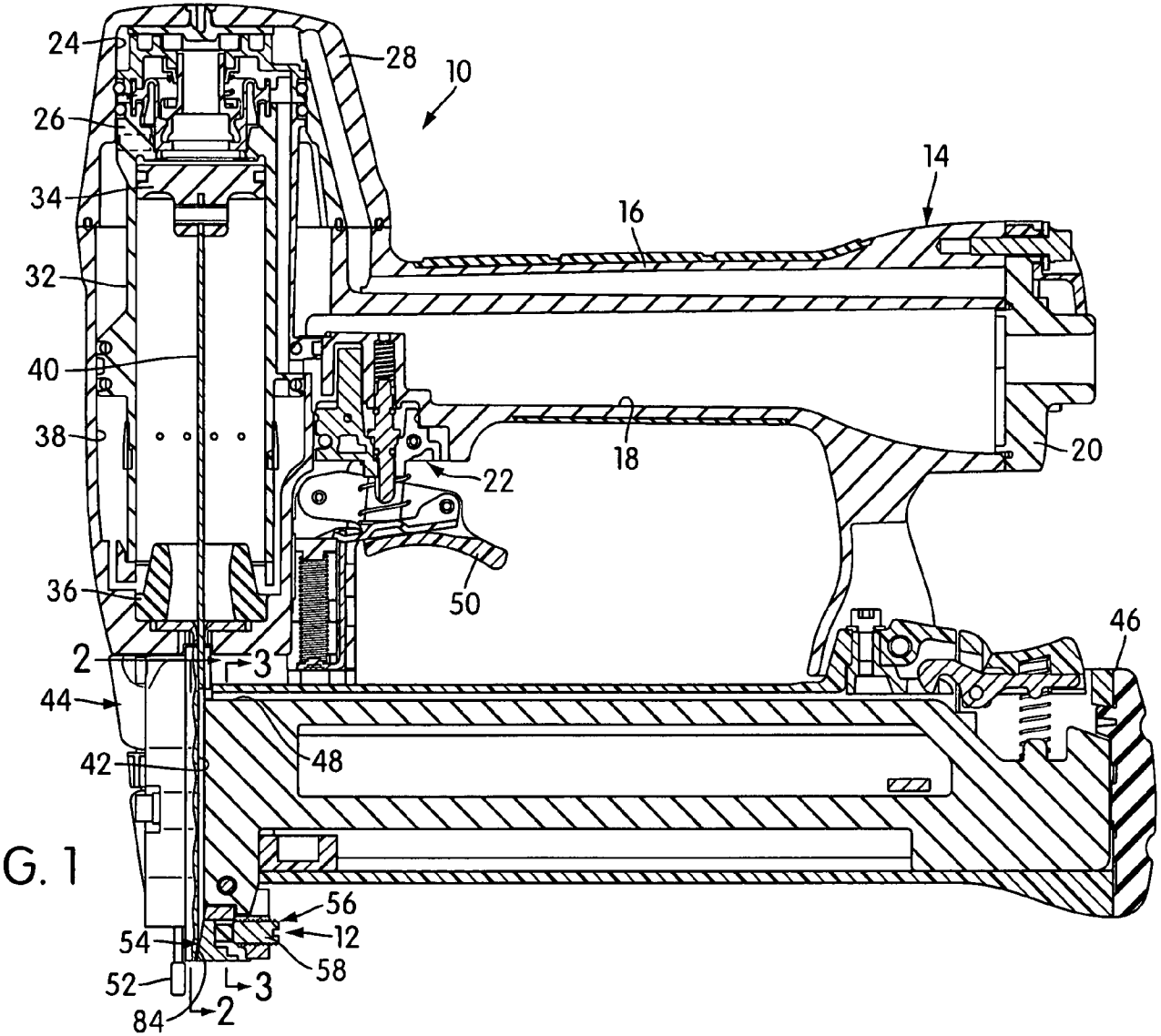
FIG. 1 is a vertical sectional view of a stapler embodying the principles of the present invention.
Figure 2:
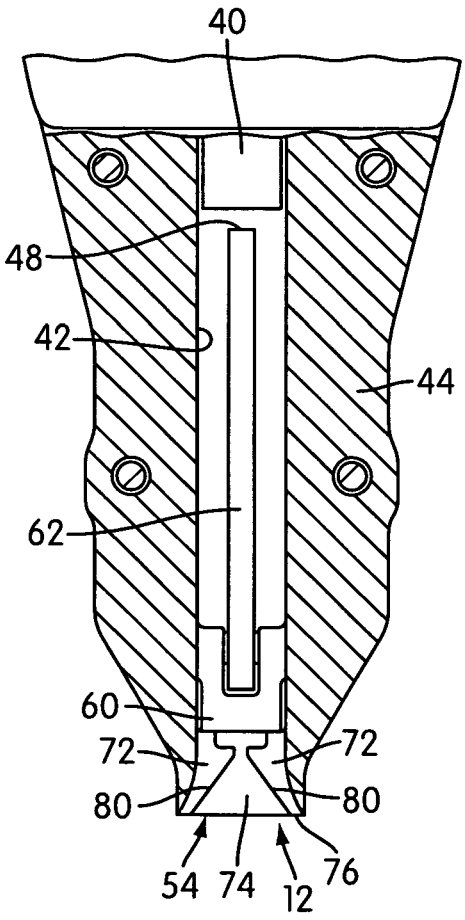
FIG. 2 is an enlarged sectional view taken along the line 2-2 of FIG. 1.

Referring now more particularly to the drawings, there is shown in FIG. 1 a stapler, generally indicated at 10, embodying the principles of the present invention. The invention is particularly concerned with the construction and operation of an outward clinching mechanism, generally indicated at 12, embodied in the stapler 10. The stapler 10 itself may be of any known configuration. As shown, the stapler 10 is power operated. Such power operation can be of any well known type such as electrical, internal combustion or pneumatic. The stapler 10 as shown in FIG. 1 is a typical pneumatically powered unit.

Specifically, the pneumatically powered stapler 10 shown in FIG. 1 includes the usual portable housing or frame structure, generally indicated at 14. The portable structure 14 includes a handle section 16 which is hollow so as to define a pneumatic reservoir 18. A fitting 20 leads to the reservoir 18 enabling a source of air under pressure (not shown) to be communicated with the reservoir 18.

The reservoir 18 communicates with a manually operable trigger valve assembly 22 which controls the communication of the reservoir to a pilot pressure chamber 24 of a main valve assembly 26. The main valve assembly 26 is housed within a cap assembly 28, fixed to the top of a main housing section 30, integral with and extending generally perpendicular to the handle section 16, both of which form parts of the portable structure 14.

Mounted within the main housing section 30 is a cylinder 32, an upper end of which cooperates with the main valve assembly 26 to enable the main valve assembly 26 to function in the usual fashion when in an inoperative position wherein the pilot pressure chamber 24, under the control of trigger valve assembly 22 in its inoperative position is communicated with the reservoir. When in its inoperative position, the main valve assembly 26 also functions to communicate the open end of the cylinder 32 with atmosphere through the cap assembly 28.

When the trigger valve assembly 22 is manually moved from its inoperative position into an operative position, the pilot pressure chamber 24 is shut off from communication with the reservoir 18 and communicated with atmosphere. The pressure from the reservoir 18 then acts upon the main valve assembly 26 to move it from its inoperative position into an operative position. In its operative position, the main valve assembly 26 functions to shut off the communication of the open upper end of the cylinder 32 with the atmosphere and to allow full peripheral communication thereof with the reservoir 18.

Communication of the reservoir 18 with the open upper end of the cylinder 32 serves to drive a piston 34 slidably mounted within the cylinder 32 through a fastener drive stroke which is completed when the piston 34 engages a shock absorbing bumper 36 mounted in the main housing section 30 below the lower end of the cylinder 32 which is fixed therein.

The drive stroke of the piston 34 constitutes one stroke of a two stroke cycle of movement the piston undergoes on a successive basis in accordance with the manual movement of the trigger valve assembly 22. The other stroke of the piston 34 which constitutes a return stroke is accomplished by a suitable return system 38. The return system can be of any known type, the return system 38 being of the air plenum chamber type.

The drive stroke of the piston 34 serves to move a staple driving element 40 connected therewith through a drive stroke within a drive track 42 formed within a nose piece assembly 44 fixed below the lower end of the main housing section 30 and forming a part of the portable structure 14. The drive stroke of the staple driving element 40 serves to drive a leading staple from a supply of staples contained within a staple magazine assembly 46 which has been laterally moved into the drive track 42 along a feed track 48 defined by the magazine assembly 46.

The magazine assembly 46, which is fixed to the nose piece assembly 44 and extends below and is fixed to the handle section 16, can be of any known type. The magazine assembly 46, as shown, is a conventional bottom loader capable of handling staples in a stack formation supply.

The trigger valve assembly 22 is manually moved from its inoperative position into its operative position by the coordinated movement of a trigger 50 and contact trip assembly 52, both of which are of any conventional construction so as to require any known coordination to effect operation.

Figure 4:
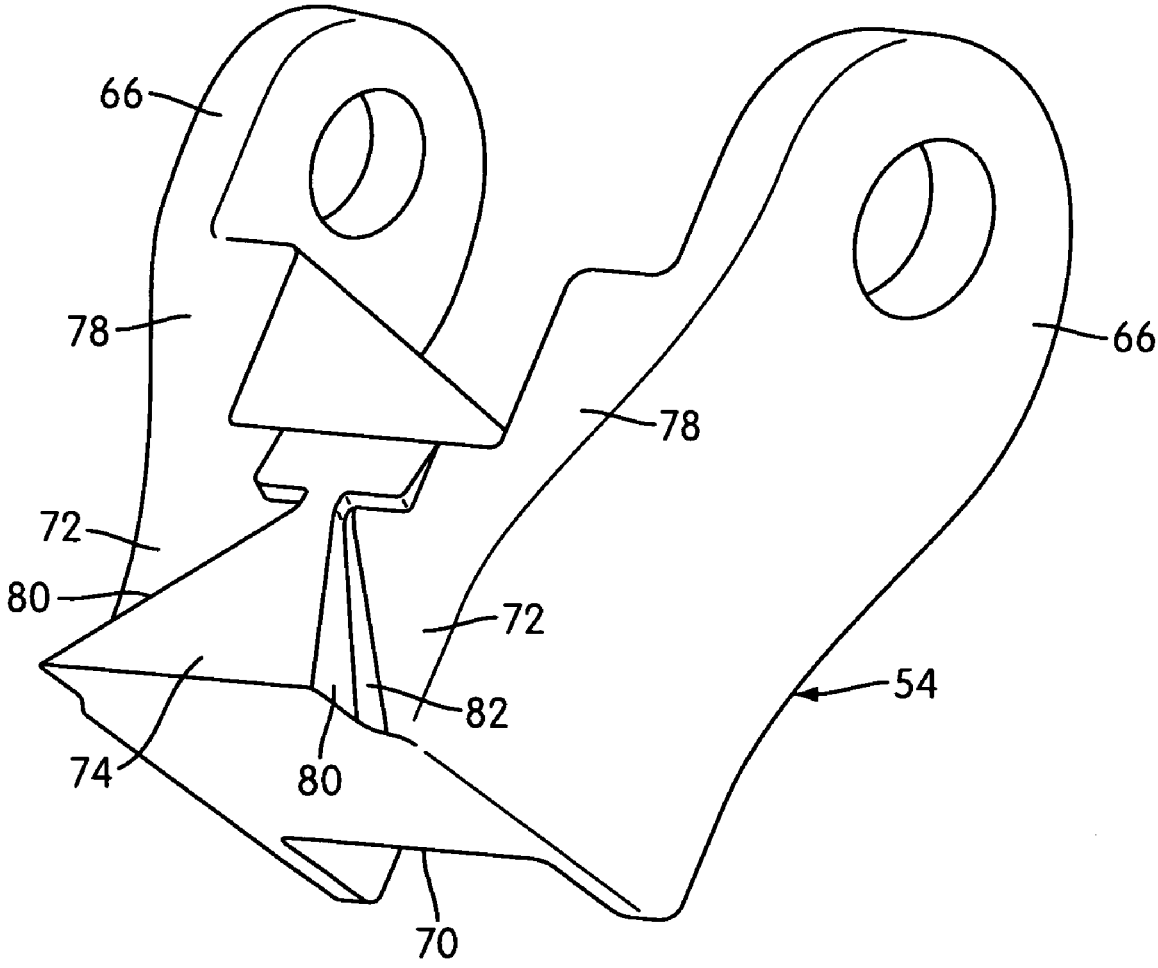
FIG. 4 is a perspective view of the anvil embodied in the outward clinching mechanism of the present invention.
Figure 5:
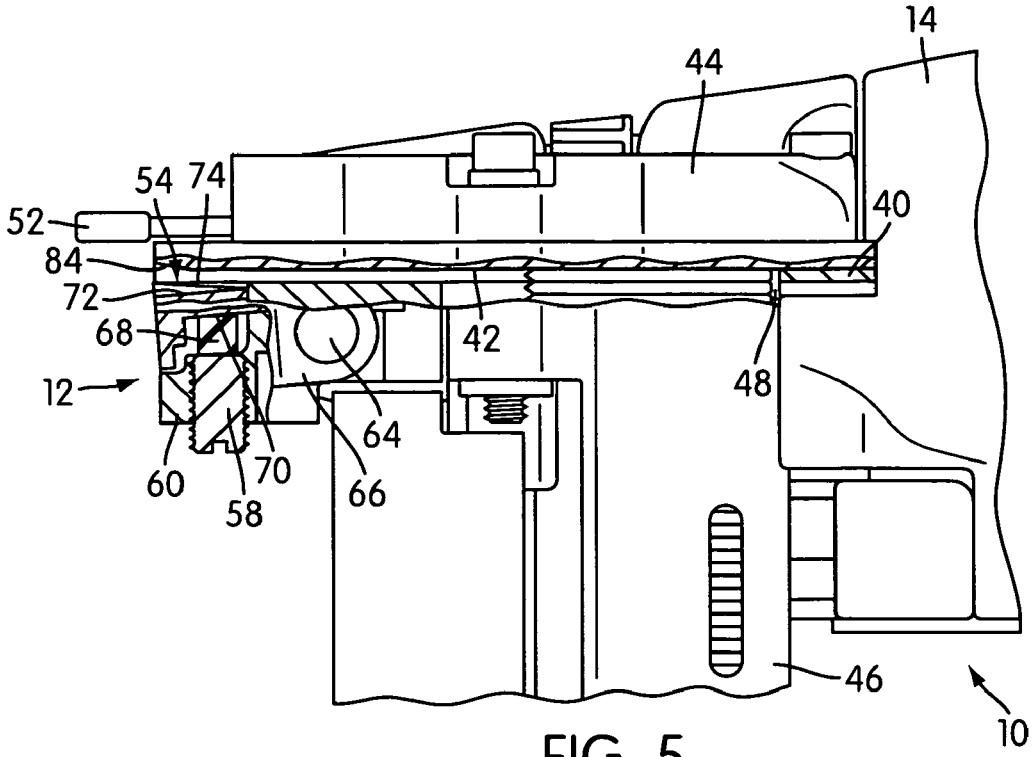
FIG. 5 is a fragmentary elevational view with parts broken away to more clearly illustrate the condition of the outward clinching mechanism of the stapler when in an inoperative position facing upwardly in preparation of driving a staple into a vertical surface of a workpiece.

The outward clinching mechanism 12 preferably comprises as basic components thereof, a pivoted anvil or clinching member, generally indicated at 54, shown in perspective in FIG. 4, and an anvil bias adjusting assembly, generally indicated at 56. The anvil bias adjusting assembly 56 serves to impose on the pivoted anvil 54 a force which biases the anvil 54 in a direction toward and into the drive track 42. The biasing force (1) can be varied within a range corresponding with a range of outward clinch deflections of the staple legs and (2) can be relieved to allow the anvil 54 to be gravity biased corresponding with a no significant outward deflection of the staple legs. In a preferred embodiment of the invention, the anvil bias adjusting assembly 54 includes a single adjusting member 58 preferably in the form of a threaded set screw as shown in the drawings, which can be manually turned with a suitable hand tool into different positions of adjustment so as to achieve both the range of leg outward deflections and the no significant leg deflection recited above.

Figure 3:
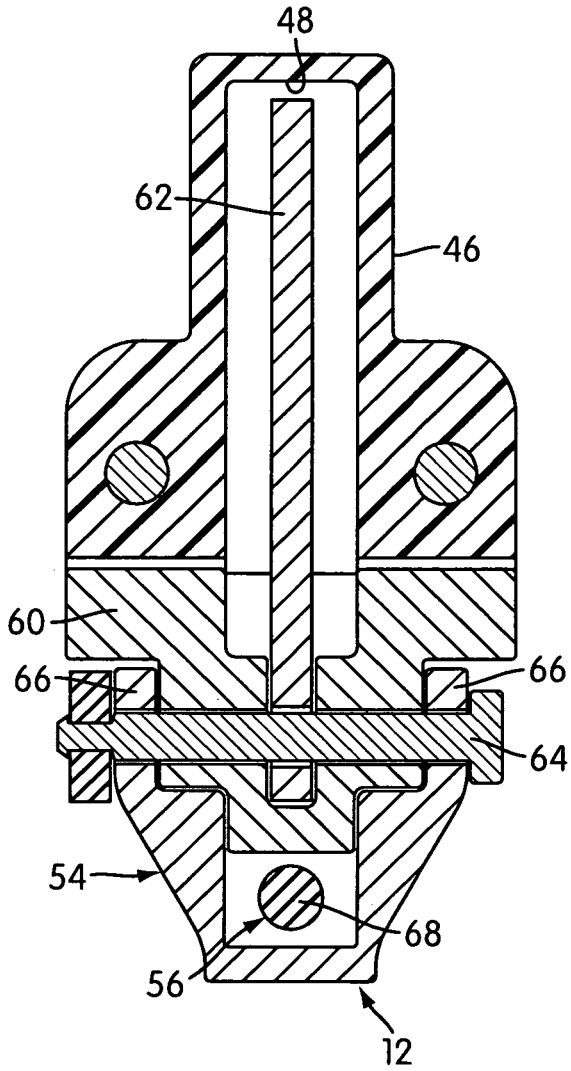
FIG. 3 is an enlarged sectional view taken along the line 3-3 of FIG. 1.

The adjusting set screw 58 is threaded within a threaded aperture formed in a bifurcated mounting member 60 fixedly mounted on a lower forward end portion of a central plate 62, shown in FIG. 3, of the magazine assembly 46. The central plate 62 constitutes a fixed part of the magazine assembly 46 when it is in its normal operating position. In the bottom loading type of magazine assembly 46 shown, the central plate 62 forms a fixed part of the movable subassembly of the magazine assembly 46 which is normally latched in a fixed position during operation, but which can be unlatched and moved rearwardly to allow for the loading of a new supply of staples in stick form in the feed track 48 through the open bottom after which the movable subassembly is moved back into its normal latched position.

As best shown in FIG. 3, the bifurcations of the mounting member 60 are disposed on opposite sides of the central magazine plate 62 and secured in position by a pivot pin 64 which also serves to pivotally mount the anvil 54 for movement toward and away from the drive track 42.

As best shown in FIGS. 3 and 4, the anvil 54 includes a pair of laterally spaced mounting portions 66 which receive the bifurcations of the mounting member 60 therebetween and are apertured to receive the pivot pin 64 therethrough.

The adjusting assembly 56 also includes a yieldable biasing member 68, preferably in the form of a rubber cylinder as shown in the drawings. The biasing member 68 is positioned below the pivot pin 64 within the mounting member 60 between a surface 70 of the back face of the anvil 54 and an end surface of the adjusting set screw 58.

As shown in FIG. 4, the forward face of the anvil 54 is configured to provide a pair of laterally spaced very slightly angled forwardly facing staple leg engaging surfaces 72 and a much more severely angled staple crown engaging surface 74 disposed therebetween. As shown, the crown engaging surface 74 is in the form of a triangle with a T at its apex. This illustration is not intended to be limiting in any way. For example, in some embodiments, the crown engaging surface 74 may be in the form of a triangle, without a T at its apex. The base of the triangle of the crown engaging surface 74 has a width generally equal to the width of the drive track 42 and is disposed at the discharge end of the drive track 42. The surfaces of the nose piece assembly 44 defining the opposite sides of the outer extremity of the drive track 42 are flared oppositely outwardly, as indicated at 76 in FIGS. 2, 7, 8, 11-14 and 17-19. The base of the crown engaging surface 74 is spaced from the adjacent staple leg engaging surfaces 72 a distance generally equal to the thickness of the staple driving element so as to enter fully into the drive track 42 when the anvil 54 is biased into its operative position, as determined by the engagement of a pair of laterally spaced, forwardly facing, stop surfaces 78 with cooperating rearwardly facing stop surfaces provided on the mounting member 60.

Extending from the converging ends of the triangular portion of the crown engaging surface 74 are a pair of transversely extending clinching surfaces 80 which merge into the leg engaging surfaces 72 along concavely arcuate transitions surfaces 82. The portions of the transversely extending clinching surfaces 80 at the base of the triangle of the crown engaging surfaces 74 are disposed in the path of travel of the legs of the staple during the driving movement and constitute the leg engaging clinching surfaces of the anvil 54 which form the outward deflection or flare of the staple when driven.

Figure 20:
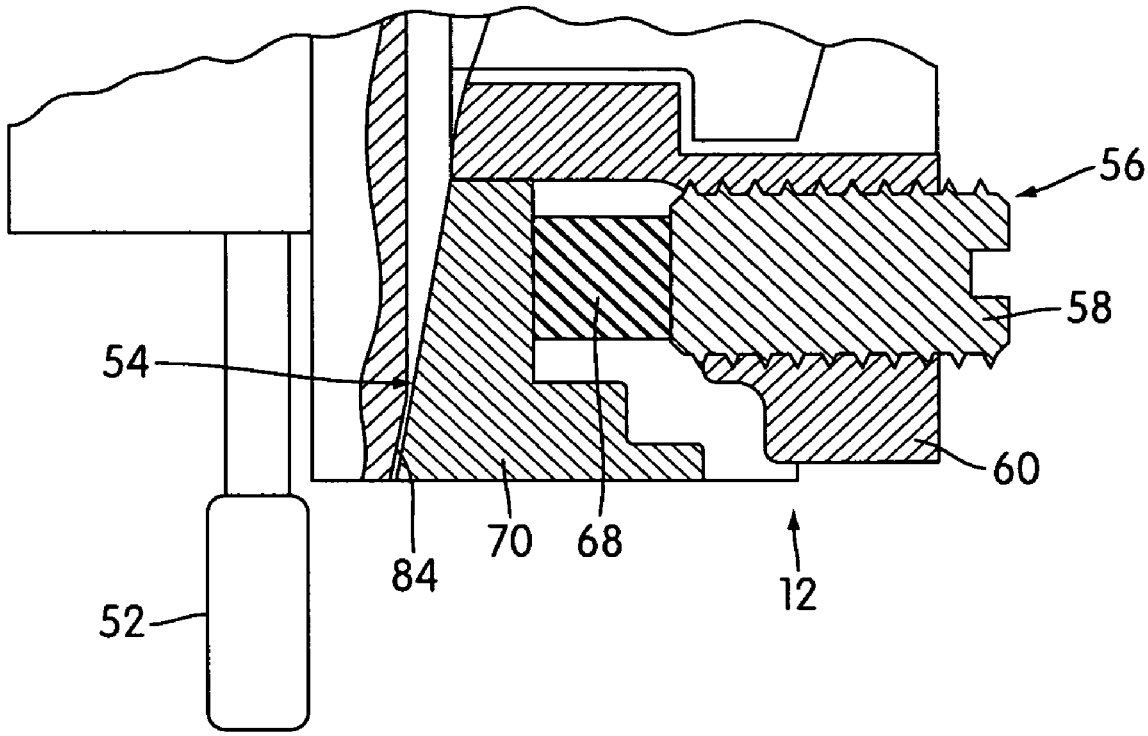
FIG. 20 is an enlarged view of a lower portion of the stapler of FIG. 1.

Also shown in the Figures, especially FIG. 20, is a chamfer 84 that is located at an outward end, or bottom, of the drive track 42. The bottom of the crown engaging surface 74 of the anvil 54 engages the chamfer 84 when the anvil 54 is biased into the drive track 42, as shown in FIG. 20. It has been found that providing the chamfer 84 at the outward end of the drive track 42 assists with the movement of the staple as the staple travels through and out of the drive track 42, especially as the flare of the staple is increased.

Operation

Figure 6:
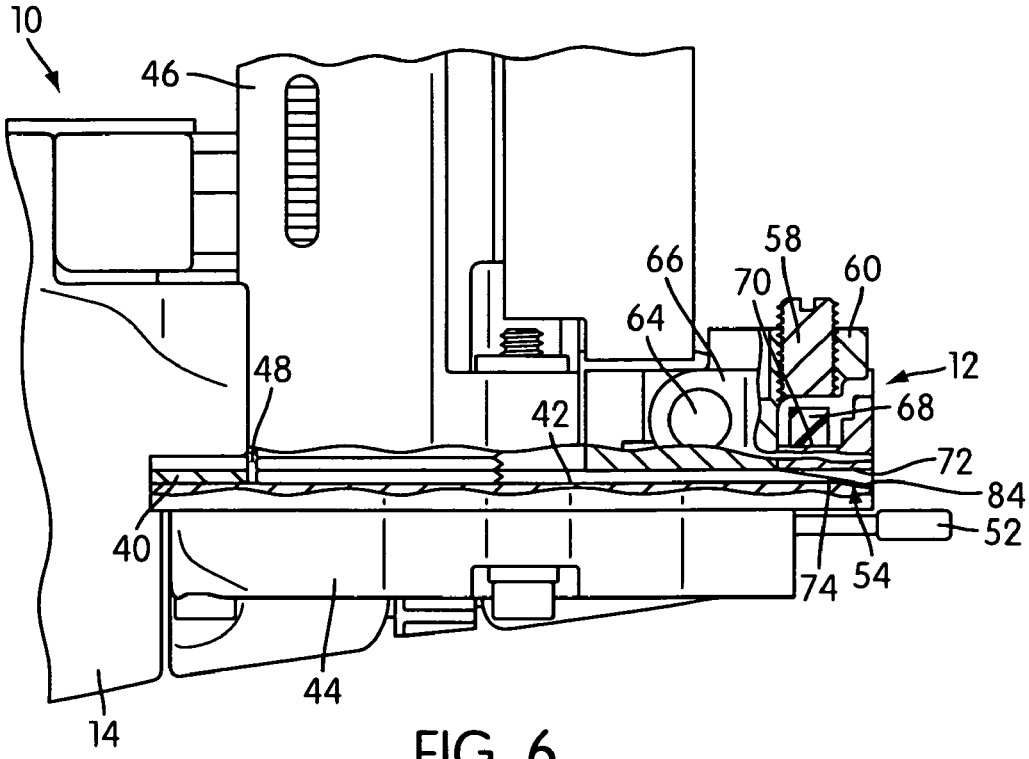
FIG. 6 is a view similar to FIG. 5 showing the condition of the outward clinching mechanism of the stapler wherein an inoperative position facing downwardly in preparation for driving a staple into a vertical surface of a workpiece.
Figure 7:
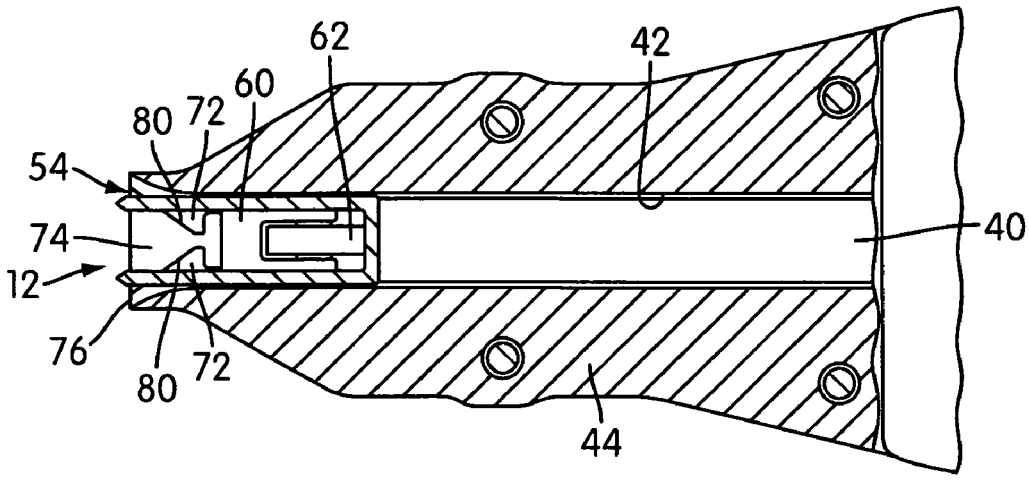
FIG. 7 is a view similar to FIG. 2, oriented as in FIG. 5, with the outward clinching mechanism adjusted to a no clinch setting showing the position of the parts during an initial driving movement of staple along the drive track.
Figure 8:
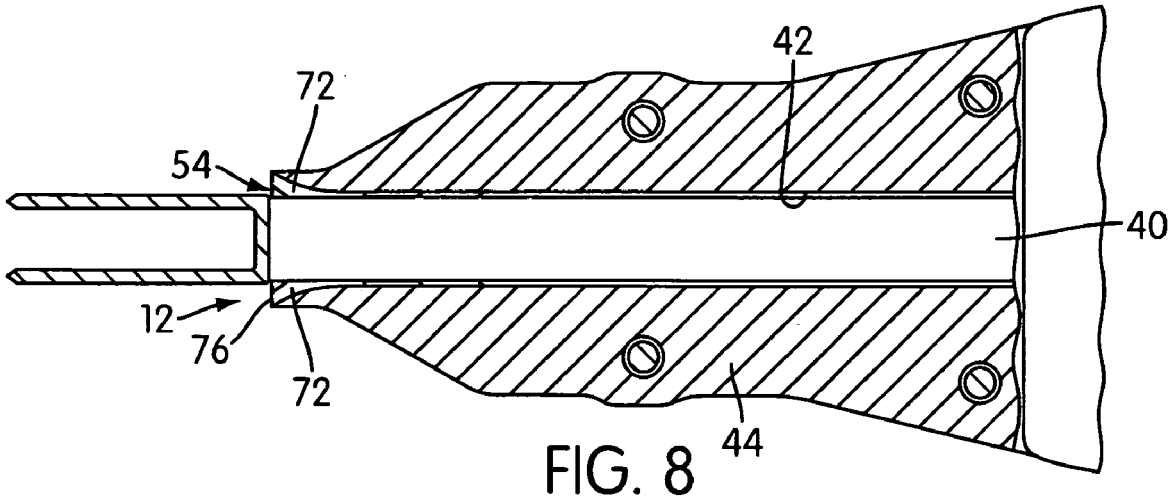
FIG. 8 is a view similar to FIG. 7 showing the position of the outward clinching mechanism parts during the final driving movement of the staple.

FIGS. 5-8 illustrate the condition of the outward clinching mechanism 12 when the single adjusting member 58 is adjusted to a no clinch operative position. As can be seen from FIGS. 5 and 6, the adjusting member 58 is turned in a counterclockwise direction to an extent which allows the yieldable biasing member 68 to be freely movable between the adjusting member 58 and the anvil 54. The anvil 54 is actually biased by its own weight when the stapler 10 is oriented in the position shown in FIG. 5. The anvil 54 will actually move pivotally about the pivot pin 64 into a position where the entire crown engaging surface 74 is disposed below and out of the drive track of 42. Since the drive track 42 is clear of any obstruction, the staple can be driven outwardly by the staple driving element 40 during its drive stroke directly into the workpiece without any significant outward deflection or flare being imposed on the legs of the staple, as shown in FIG. 8.

FIG. 6 illustrates the reverse situation where the stapler 10 is oriented in a position such that the anvil 54 will be gravity biased in a clockwise direction about its pivot pin 64 so as to engage the stop surfaces 78 and dispose the crown engaging surfaces 74 as well as the leg engaging surfaces 72, 80 and 82 within the drive track 42. It will be understood that the driving movement of the staple driving element 40 in a pneumatically operated device, such as the stapler 10 described above, is a very rapid movement and there is a distance of travel that the staple must move before engaging any of the surfaces of the anvil 54 which are disposed in the drive track 42. Thus, the engagement will be an impact engagement. Since the free ends of the legs of the staple are leading in the drive track 42 during the driving motion, they will engage the leg engaging surfaces 72 initially. These surfaces 72, while having only a slight incline, are sufficient, when impacted with the anvil 54 under gravity bias, to quickly move the entire anvil 54 including the surfaces 74 and 80 out of the drive track 42. As soon as the impact force moves all of the surfaces of the anvil 54 out of the drive track 42, the gravity acting on the anvil 54 tends to bias it so that the surfaces 74 and 80 thereof move back toward the drive track 42. By this time, however, the legs of the staple have moved into a position which normally would be occupied by the ends of the base of the crown engaging surface 74. Consequently, instead of the anvil surfaces entering into the drive track 42, the crown engaging surface 74 will engage the legs of the staple and prevent the entry of the anvil back into the drive track 42. The ends of the base of the crown engaging surface 74 will remain in biased engagement with the staple legs as the driving action is completed.

It will be noted that in the event that the engagement of the free ends of the legs of the staple with the staple leg engaging surfaces 72 is insufficient to move the anvil 54 out of the drive track 42, the legs of the staple will then engage the arcuate transition surfaces 82 which provide for a somewhat steeper incline insuring that the transversely extending clinching surfaces 80 of the anvil 54 are moved out of the drive track 42 before the free ends of the legs of the staple can move into engagement therewith. A momentary engagement may result in a insignificant outward flare. Consequently, the no clinch position ensures that the staple will be driven into the workpiece with no significant outward flare. This condition is illustrated in FIGS. 7 and 8.

It should be noted that the adjusting assembly of 56 in this position still provides a bias on the anvil 54. The bias is a gravity bias so that when the stapler 10 is in the orientation shown in FIG. 5, the bias is a negative bias whereas when the stapler 10 is in an orientation such as shown in FIG. 6, the bias is simply a positive gravity bias. It will be understood that while the single adjusting member 58 and yieldable biasing member 68 are shown as being separate from one another and from the anvil 54, they could be interconnected to provide for unitary linear movement while permitting relative rotational movement either between the single adjusting member 58 and the yieldable biasing member 68 or between the two of them and the anvil 54. With this modification, which is within the contemplation of the present invention, the movement of the single adjusting member 58 into the no clinch position would hold the surfaces 72 and 74 of the anvil 54 out of the drive track 42 at all times, thus providing a zero bias.

Figure 9:
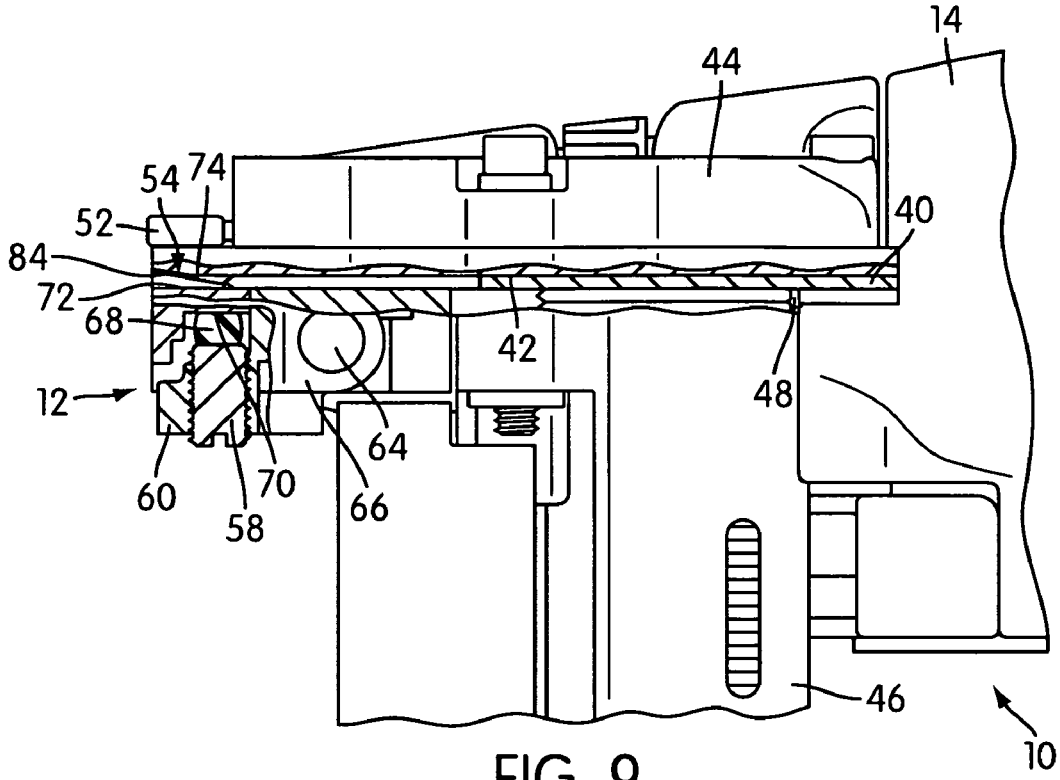
FIG. 9 is a view similar to FIG. 5 with the outward clinching mechanism adjusted to a minimum deflection or flare setting showing the position of the parts during the driving movement of the staple just before the ends of the staple legs have engaged the anvil clinching surfaces.
Figure 10:
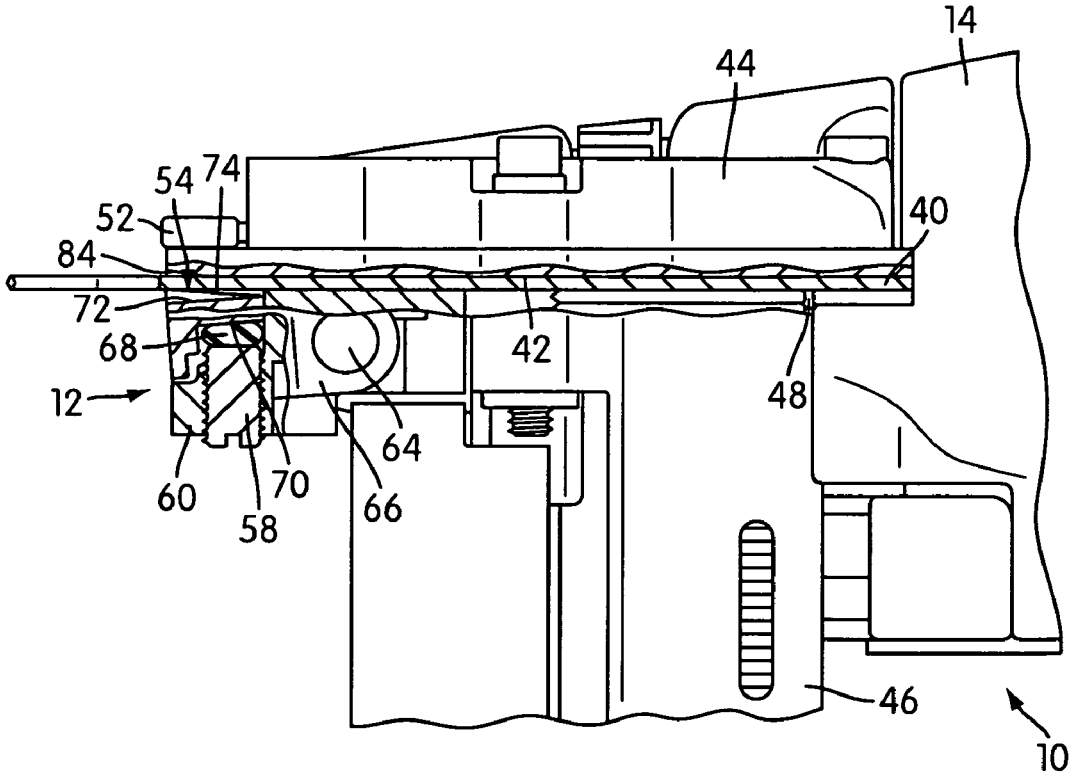
FIG. 10 is a view similar to FIG. 9 showing the position of the parts at the end of the driving movement.

FIGS. 9-14 illustrate the condition of the outward clinching mechanism 12 when the single adjusting member 58 is moved into a minimal outward deflection position or at the less severe range of outward deflections provided by the adjusting assembly 56. As best shown in FIG. 9, in this position, the single adjusting member 58 has been turned inwardly to cause the yieldable biasing member 58 to engage the surface 70 of the anvil 54 and move the stop surfaces 78 into engagement and the surfaces 72, 74, 80 and 82 of the anvil 54 into the drive track 42. As shown, there is a slight compression of the yieldable biasing member 68 retaining the anvil member 54 in that position. In this condition, when the free ends of the legs of the staple initially engage the staple leg engaging surfaces 72 and then the arcuate transition surfaces 82, there is insufficient impact force created to move the ends of the transversely extending clinching surfaces 80 and crown engaging surface 74 out of the drive track 42. Consequently, as the free ends of the legs of the staple move past the arcuate transition surfaces 82, they will next engage the transversely extending clinching surfaces 80 causing the free ends to flare outwardly, which movement is permitted by the flared drive track surfaces 76.

As the staple continues to move, the engagement of the surfaces 80 with the legs of the staple effect a continued outward flare or deflection thereto until the crown of the staple moves into engagement with the initial portion of the crown engaging surface 74. The impact of the engagement of the staple crown with the surface 74 is sufficient to overcome the bias of the yieldable biasing member 68 causing the surfaces 74 and 80 of the anvil 54 to move out of the drive track 42. This movement disengages the transversely extending clinching surfaces 80 from the legs of the staple, thereby ending the outward deflection imparted thereto. As soon as the anvil 54 moves out of the drive track 42, the yieldable biasing member 68 tends to bias the anvil 54 back toward the drive track 42. However, by the time this bias can be effective, the legs of the staple have moved into a position to be engaged by the ends of the base of the crown engaging surface 74. As before, the anvil 42 remains out of the drive track 42 for the remainder of the driving movement of the staple.

Figure 11:
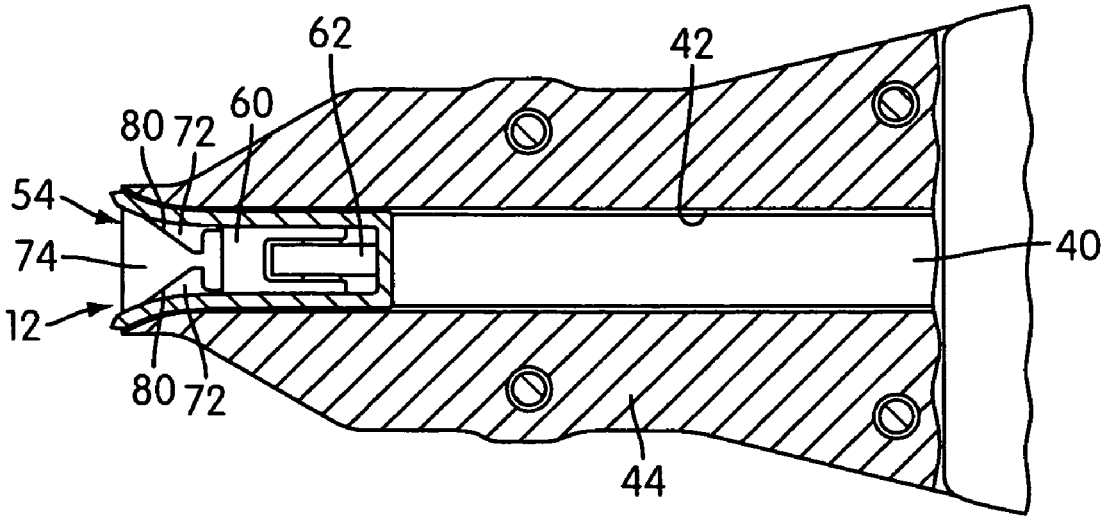
FIG. 11 is a view similar to FIG. 5 with the outward clinching mechanism in the setting shown in FIG. 9 showing the outward clinching mechanism parts in a position similar to FIG. 7.
Figure 12:
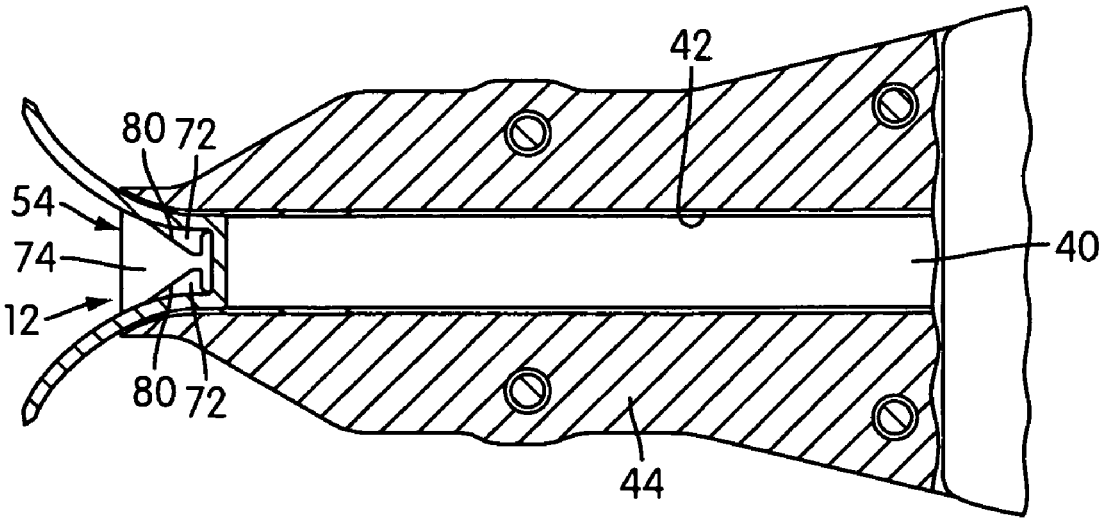
FIG. 12 is a view similar to FIG. 11 showing the position of the outward clinching mechanism parts when the anvil is moved out of the drive track.
Figure 13:
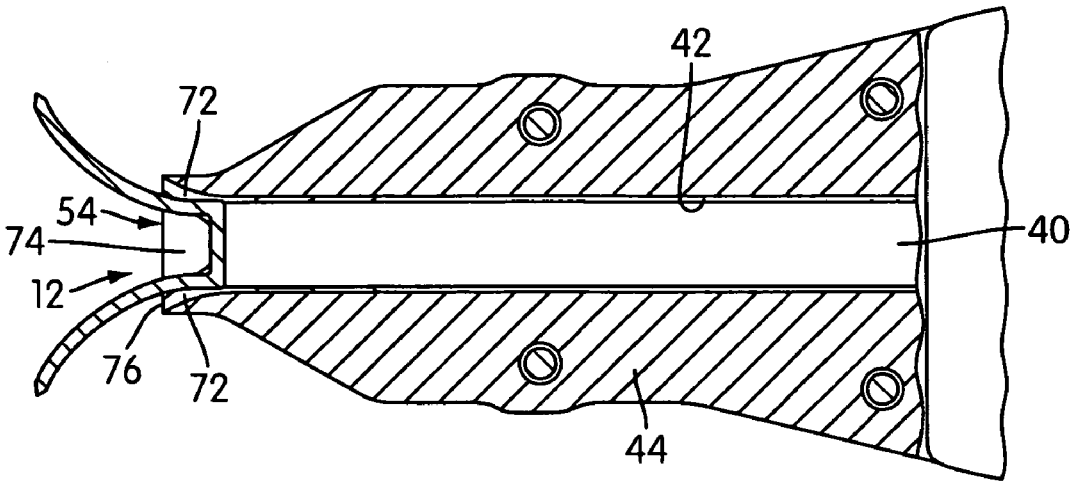
FIG. 13 is a view similar to FIG. 12 showing the position of the outward clinching mechanism parts when the anvil is biased to move back toward the anvil.
Figure 14:
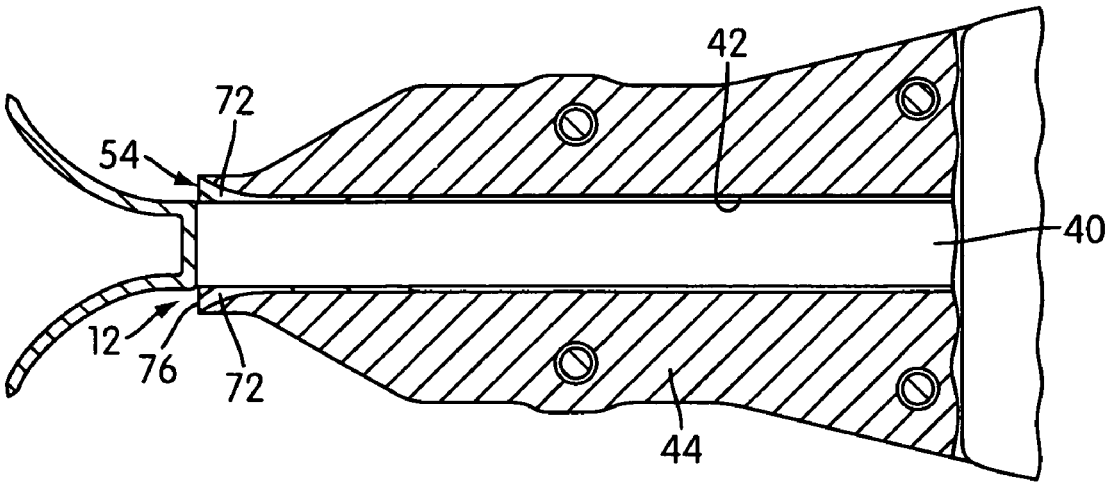
FIG. 14 is a view similar to FIG. 13 showing the position of the outward clinching mechanism parts at the end of the driving movement.

FIG. 11 illustrates the initial engagement of the free ends of the legs of the staple with the clinching surfaces 80. FIG. 12 illustrates the position of the parts just before the anvil 54 is moved out of the drive track 42. FIG. 13 illustrates the position of the parts when the staple is moved to block the anvil 54 from entering the drive track 42. FIG. 14 illustrates the final drive position of the staple in the minimum adjustment position described.

Figure 15:
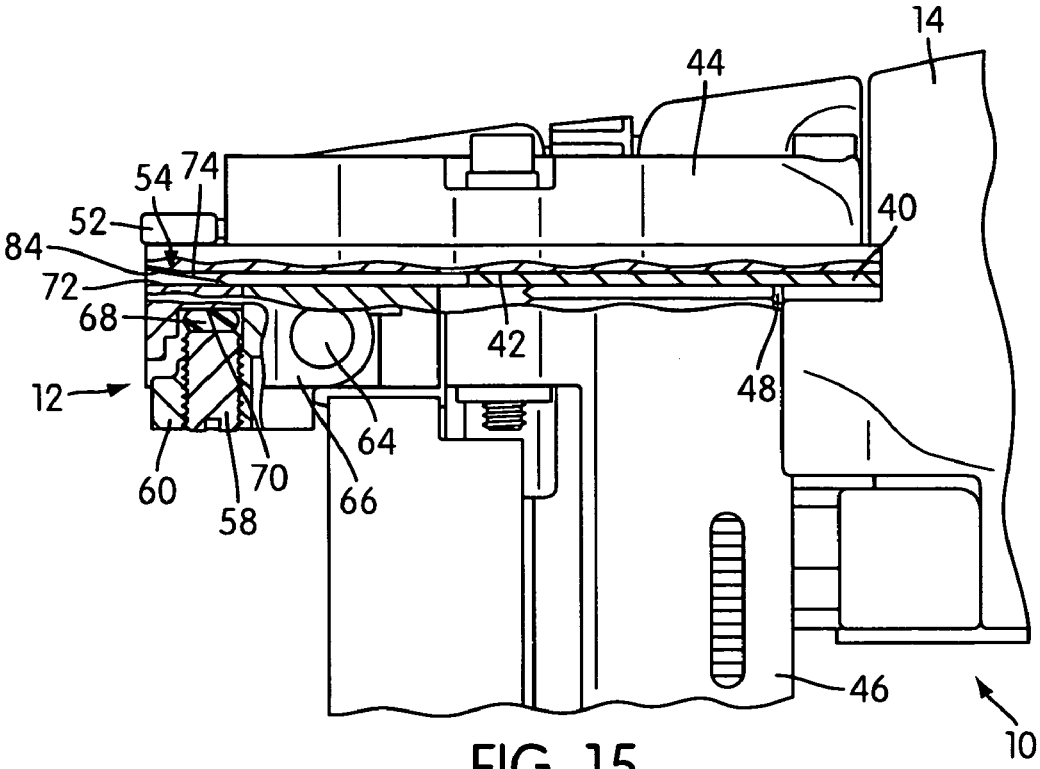
FIG. 15 is a view similar to FIG. 9 with the outward clinching mechanism in a maximum deflection or flare setting.
Figure 16:
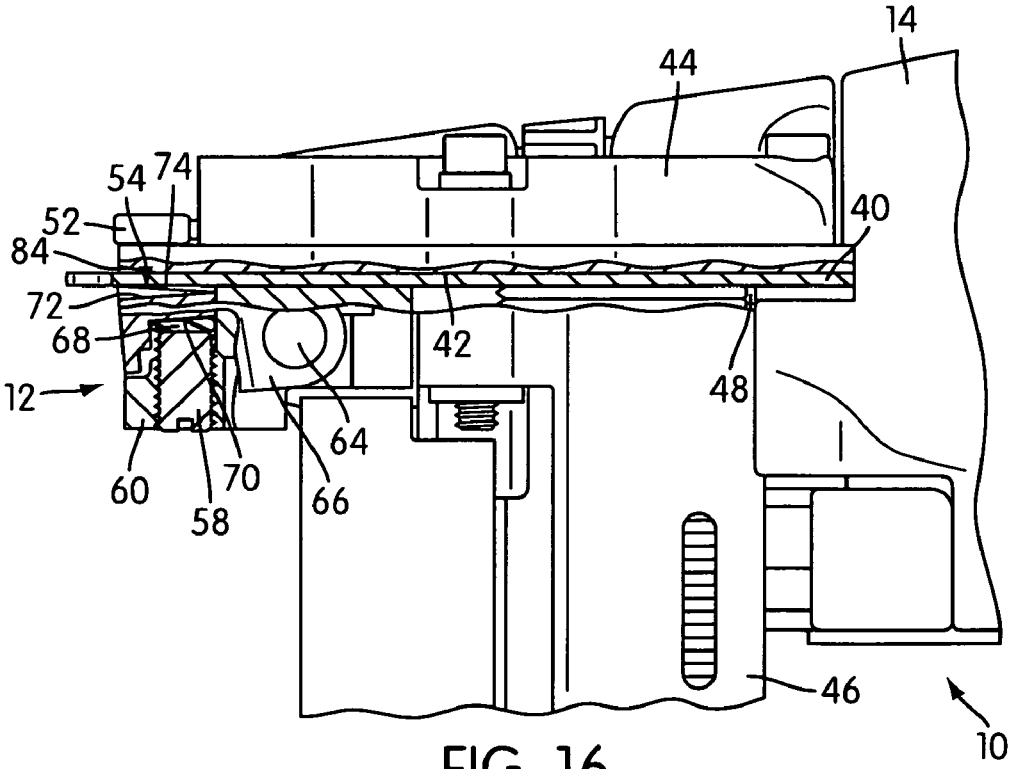
FIG. 16 is a view similar to FIG. 15 showing the position of the outward clinching mechanism parts at the end of the driving movement.
Figure 17:
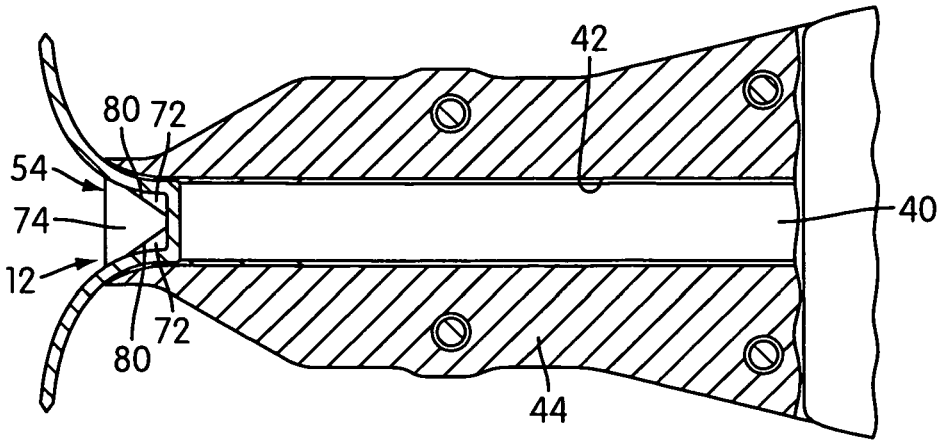
FIG. 17 is a view similar to FIG. 2 with the outward clinching mechanism in the setting of FIG. 5 showing the position of the outward clinching mechanism parts when the anvil is moved out of the drive track.
Figure 18:
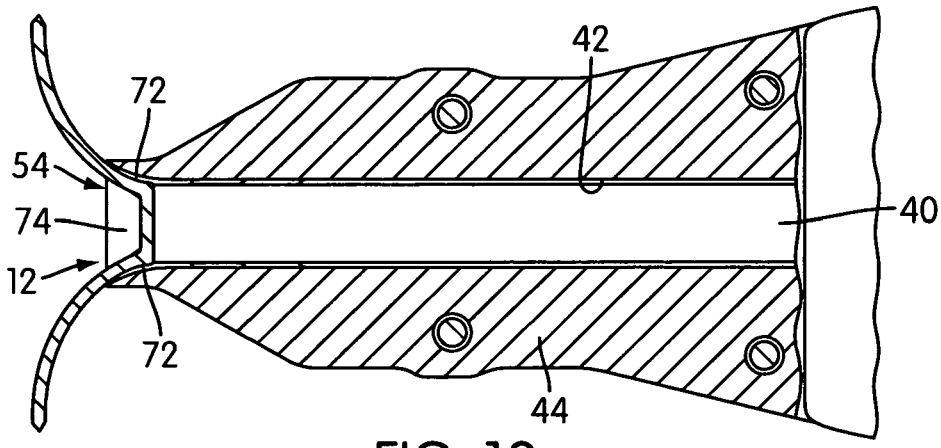
FIG. 18 is a view similar to FIG. 17 showing the position of the outward clinching mechanism parts when the anvil is biased to move back toward the drive track.
Figure 19:
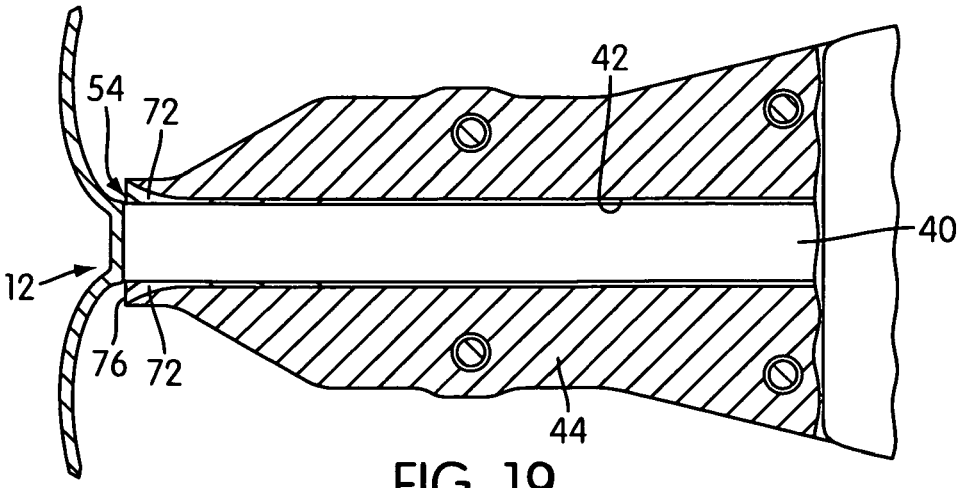
FIG. 19 is a view similar to FIG. 18 showing the position of the outward clinching mechanism parts at the end of the driving movement.

FIGS. 15-19 illustrate the condition of the outward clinching mechanism 12, when the single adjusting member 58 has been moved fully into a maximum deflection or most severe flare position. As shown in FIG. 15, the yieldable biasing member 68 has been compressed even more than the compression shown in FIG. 8, imposing a greater resistance force to the movement of the anvil 54 than previously described. In the operation at this position, the outward deflection of the staple begins and takes place in the same manner as before. However, in order to overcome the greater force applied to the anvil, a greater amount of movement of the crown of the staple along the crown-engaging surface 74 must take place before a sufficient impact force is created to overcome the greater biasing force being applied to the anvil 54 by the yieldable biasing member 68. In this way, the extent of the outward deflection of the legs of the staple is increased to a maximum and the anvil 54 and the surfaces 74 and 80 of the anvil are not moved out of the drive track 42 except at the very end of the driving movement. FIG. 17 illustrates the position at which the anvil 54 is moved out of the drive track 42. FIG. 18 illustrates the position when the anvil 54 is blocked from moving back into the drive track 42 and FIG. 19 illustrates the final drive.

While preferred embodiments of the invention have been shown and described, they are not intended to be limiting in any respect. To the contrary, the invention is intended to encompass all variations and modifications within the spirit and scope of the appended claims.

What is claimed is:

1. A stapler for driving successive staples into a workpiece, each staple having a crown and legs extending from opposite crown ends, the stapler comprising:

a drive track;

a magazine assembly constructed and arranged to supply successive leading staples into said drive track;

a staple driver mounted in said drive track for movement through successive cycles including:

(1) a drive stroke during which a leading staple in said drive track is moved by said staple driver outwardly of said drive track and into a workpiece; and (2) a return stroke;

a staple leg diverter constructed and arranged for lateral movement out of and into said drive track, said staple diverter deflecting the legs of a driven staple during the drive stroke; and a one-piece selectively operable adjuster operatively associated with the staple leg diverter, the one-piece selectively operable adjuster being constructed and arranged to be adjusted laterally with respect to the drive track within a range of leg deflecting positions to affect the lateral movement of the staple leg diverter, wherein the different leg deflective positions effects an amount to which the diverter will deflect the legs of the driven staple during the drive stroke, and wherein rotation of the one-piece selectively operable adjuster both moves the adjuster and retains the adjuster in an adjusted position within the range of leg deflecting positions.

2. The stapler according to claim 1, wherein one of said leg deflecting positions corresponds to a position in which the staple leg diverter causes no significant deflection of the legs of the driven staple during the drive stroke.

3. The stapler according to claim 1, further comprising a yieldable biasing member between said adjuster and said staple leg diverter, wherein said adjuster is selectively adjusted within said range of positions to adjust an amount of bias of said biasing member acting on said leg diverter.

4. The stapler according to claim 3, wherein said staple leg diverter includes an anvil having two leg engaging surfaces having a slight slope in a direction to create a force acting to move the anvil away from the drive track when impacted by legs of the staple during the drive stroke by the said staple driver.

5. The stapler according to claim 4, wherein said anvil includes a crown engaging surface having a greater slope than said leg engaging surfaces disposed to. create a force acting to move the anvil in a direction away from the drive track when impacted by the crown of the staple during the drive stroke thereof by the staple driver.

6. The stapler according to claim 5, wherein said anvil includes leg clinching surfaces extending transversely from diverging sides of said crown engaging surface.

7. The stapler according to claim 6, wherein said anvil includes arcuate transition surfaces between said clinching surfaces and said leg engaging surfaces.

8. The stapler according to claim 7, wherein said adjuster includes a threaded structure engaged in a mounting member fixed with respect to said drive track.

9. The stapler according to claim 3, wherein said adjuster includes a threaded structure engaged in a mounting member fixed with respect to said drive track.

10. The stapler according to claim 1, wherein said magazine assembly is of bottom loader configuration including a movable subassembly which is normally latched in operative position and capable of being unlatched and moved into a loading position exposing an open bottom of said magazine assembly through which a new supply of staples in stick form can be loaded, said staple leg diverter and said one-piece selectively operable adjuster being mounted on said movable subassembly for movement therewith.

11. The stapler according to claim 1, wherein said drive track comprises a chamfer at an outward end thereof.

12. A stapler for driving successive staples into a workpiece, each staple having a crown and legs extending from opposite crown ends, the stapler comprising:

a drive track;

a staple driver mounted in said drive track for movement through successive cycles including (1) a drive stroke during which a leading staple in said drive track is moved by said staple driver outwardly of said drive track and into a workpiece; and (2) a return stroke;

a staple leg diverter constructed and arranged for lateral movement out of and into said drive track, said staple diverter deflecting the legs of a driven staple during the drive stroke;

a single selectively operable adjuster operatively associated with the staple leg diverter, the single selectively operable adjuster being constructed and arranged to be adjusted laterally with respect to the drive track within a range of leg deflecting positions to affect the lateral movement of the staple leg diverter, wherein the different leg deflective positions effects an amount to which the diverter will deflect the legs of the driven staple during the drive stroke, and wherein a single operation of the single selectively operable adjuster both moves the adjuster and retains the adjuster in an adjusted position within the range of leg deflecting positions; and a magazine assembly constructed and arranged to supply successive leading staples into said drive track, wherein said magazine assembly is of bottom loader configuration including a movable subassembly which is normally latched in operative position and capable of being unlatched and moved into a loading position exposing an open bottom of said magazine assembly through which a new supply of staples in stick form can be loaded, said staple leg diverter and said single selectively operable adjuster being mounted on said movable subassembly for movement therewith.

13. The stapler according to claim 12, wherein one of said leg deflecting positions corresponds to a position in which the staple leg diverter causes no significant deflection of the legs of the driven staple during the drive stroke.

14. The stapler according to claim 12, further comprising a yieldable biasing member between said adjuster and said staple leg diverter, wherein said adjuster is selectively adjusted within said range of positions to adjust an amount of bias of said biasing member acting on said leg diverter.

15. The stapler according to claim 14, wherein said staple leg diverter includes an anvil having two leg engaging surfaces having a slight slope in a direction to create a force acting to move the anvil away from the drive track when impacted by legs of the staple during the drive stroke by the said staple driver.

16. The stapler according to claim 15, wherein said anvil includes a crown engaging surface having a greater slope than said leg engaging surfaces disposed to create a force acting to move the anvil in a direction away from the drive track when impacted by the crown of the staple during the drive stroke thereof by the staple driver.

17. The stapler according to claim 16, wherein said anvil includes leg clinching surfaces extending transversely from diverging sides of said crown engaging surface.

18. The stapler according to claim 17, wherein said anvil includes arcuate transition surfaces between said clinching surfaces and said leg engaging surfaces.

19. The stapler according to claim 14, wherein said adjuster includes a threaded structure engaged in a mounting member fixed with respect to said drive track.

20. The stapler according to claim 12, wherein said drive track comprises a chamfer at an outward end thereof.

* * * * *